United States Patent [19]

Theodore et al.

[11] 4,029,573

[45] June 14, 1977

[54] WASTE SEGREGATING APPARATUS

[75] Inventors: Michael J. Theodore, Weston; John S. DiMercurio, Medford, both of Mass.

[73] Assignee: Raytheon Company, Lexington, Mass.

[22] Filed: Mar. 17, 1975

[21] Appl. No.: 559,342

[52] U.S. Cl. ..... 209/212; 209/223 R; 209/231

[51] Int. Cl.[2] ..... B03C 1/08

[58] Field of Search ..... 209/212, 213, 214, 223, 209/227, 478, 231, 216, 111.8

[56] References Cited

UNITED STATES PATENTS

| | | | |
|---|---|---|---|
| 411,899 | 10/1889 | Moffitt | 209/212 X |
| 1,024,109 | 4/1912 | Troy | 209/212 |
| 1,145,046 | 7/1915 | Weatherby | 209/478 |
| 1,416,034 | 5/1922 | Noll | 209/212 |
| 1,417,189 | 5/1922 | McCarthy | 209/212 |
| 1,463,713 | 7/1923 | Moidey | 209/227 |
| 3,824,516 | 7/1974 | Renowitz | 209/212 X |

*Primary Examiner*—Robert Halper
*Attorney, Agent, or Firm*—Harold A. Murphy; Joseph D. Pannone; John T. Meaney

[57] ABSTRACT

Waste segregating apparatus for separating selected nonferromagnetic conductive metals from other nonferromagnetic materials in a commingled supply thereof, comprising means for forming a moving supply of shredded nonferromagnetic materials into a plurality of streams, a first separation stage comprising a plurality of adjustable ramps for receiving respective streams and including steady-state magnetic means for splitting each stream into at least three streamlets containing materials having different conductivity characteristics, and a second separation stage comprising additional ramps for receiving selected ones of said streamlets and separating them still further into additional streamlets.

14 Claims, 11 Drawing Figures

82
84
80
82
84
74a
76a
75a
75
78
74
72
76
70
85
86
90

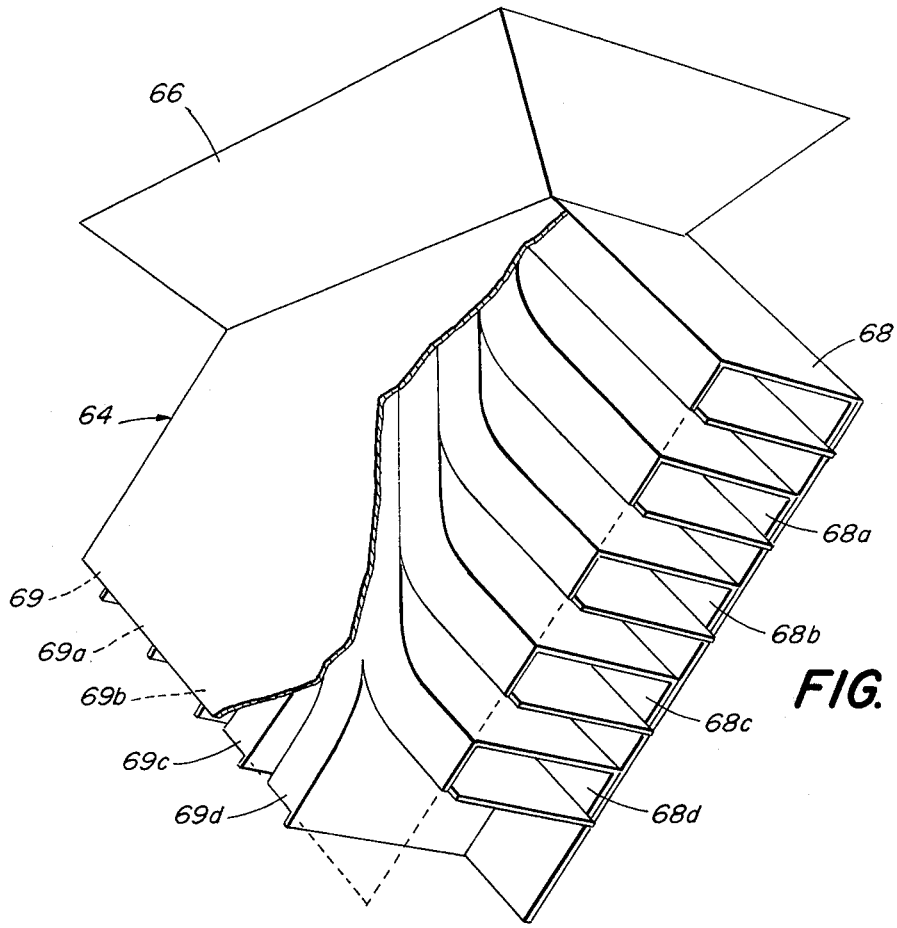
FIG. 5
FIG. 6
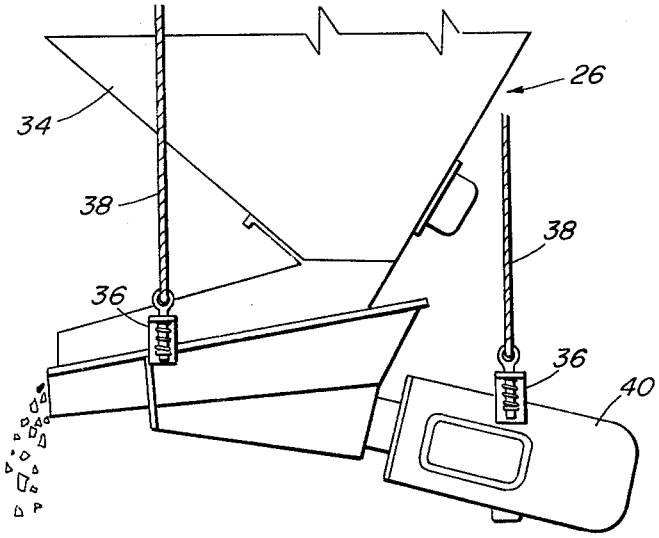
FIG. 7
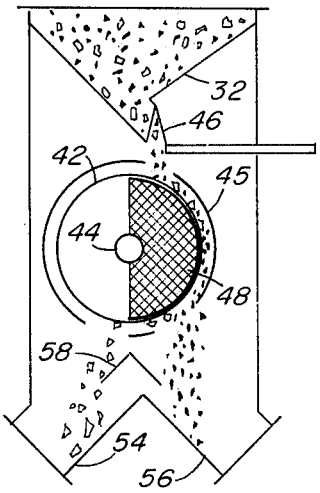

WASTE SEGREGATING APPARATUS

BACKGROUND OF THE INVENTION

This invention relates generally to materials segregating apparatus and has particular reference to apparatus for segregating selected conductive nonferromagnetic metals from a mass or supply of commingled nonferromagnetic materials.

Solid municipal waste may be shredded and then classified into light and heavy fractions, each having therein items suitable for recycling. The light fraction, for example, usually includes paper and cardboard which may be used in the production of new paper products or may be sold as combustible fuel. The heavy fraction generally is comprised of glass, ceramic, wood, ferromagnetic materials, and nonferromagnetic materials for examples. The ferromagnetic materials may be extracted by conventional means, such as electromagnets, and subsequently used in the manufacture of steel and other metal alloys.

The heavy fraction of nonferromagnetic municipal waste includes at least two other categories of potentially saleable items, namely nonferromagnetic metals and clean glass. The nonferromagnetic metal component of the heavy fraction generally is comprised of aluminum scrap, copper-zinc base scrap, and tin scrap, for examples. Market analysis indicates that there is a greater demand for the nonferromagnetic metals than for other components of the heavy fraction. Thus, although constituting only a small percent by weight of typical municipal waste, the nonferromagnetic metals nevertheless represent a significant percentage of the total resale value.

Of the total nonferromagnetic metal content, aluminum constitutes an important part, and at the present time it is aluminum which receives the most attention since is usually provides the highest value per ton of municipal trash.

Accordingly, prior art means have been developed for separating nonferromagnetic metals from other components of municipal waste. These prior art means generally involve heavy media separation, electrostatic separation, or electromagnetic separation.

However, heavy media separation has not been generally satisfactory due in part to fluids becoming entrapped in the crushed items of municipal waste and erratically affecting their specific gravities. Electrostatic separation generally requires the use of complicated apparatus for establishing a strong electrostatic field which induces electrostatic charges on respective items of municipal waste. Electromagnetic separation generally involves the use of sophisticated electrical equipment and circuitry for producing a time varying electromagnetic field which induces eddy-currents in the nonferromagnetic metal objects in municipal waste.

Therefore, it is advantageous and desirable to provide materials separating apparatus with simple and relatively inexpensive means for segregating the nonferromagnetic metal items in commingled waste materials. Such separation apparatus is shown and described in copending U.S. patent application Ser. No. 552,576 filed Feb. 24, 1975, which is a continuation-in-part of abandoned application Ser. No. 509,203, filed Sept. 25, 1974 by E. Schloemann. This copending application describes a material separating apparatus which comprises means for directing commingled nonferromagnetic materials including conductive metals into a stream which is intercepted by an alternating series of oppositely directed magnetic fields. These fields induce eddy currents in the conductive materials and thus exert forces such as will split the stream into a number of streamlets containing materials of different conductivity characteristics. The streamlets then are gathered into a respective supply of segregated materials.

However, apparatus such as described in the aforementioned copending application is suitable for processing only a relatively small amount of material in any given period of time.

SUMMARY OF THE INVENTION

This invention overcomes the above and other disadvantages of known materials separating devices and systems by the provision of apparatus which embodies a plurality of devices such as described in the aforementioned patent application, which devices are arranged to receive respective portions of a heavy flow of material to be separated. Separation according to this invention is performed in two stages. During the first stage material is separated into a first portion of nonconductive materials or "tailings" such as glass, paper, plastics, cloth and the like, a second portion containing nonferromagnetic conductive metal or "headings" such as aluminum, for example, and a third portion of other conductive nonferromagnetic material or "middlings" such as other metals having conductivity characteristics different from aluminum.

In the second stage the "middlings" from the first stage are reprocessed to separate therefrom any aluminum which may inadvertently be included therein as a result of being prevented for some reason from being separated into the initial heading stream. Thus, considerable efficiency is achieved.

In accordance with this invention the initial stream of waste to be segregated is diverted into a number of streamlets directed to the respective magnetic segregating ramps. Thus, a considerable amount of waste can be processed in a given period of time.

Further in accordance with this invention assembled magnetic segregating units or ramps in both the first and second stages are adjustable so that their angles of inclination may be selectively varied to most efficiently accomodate the particular batch of waste being segregated.

BRIEF DESCRIPTION OF THE DRAWINGS

The foregoing and other objectives of this invention will become apparent from the following description taken in connection with the accompanying drawings wherein:

FIG. 5 is an isometric view of the materials distributor ducts;

FIG. 6 is a side elevational view of the vibratory feeder;

FIG. 7 is a schematic illustration of the magnetic drum separator;

DESCRIPTION OF THE PREFERRED EMBODIMENT

Figure 1:
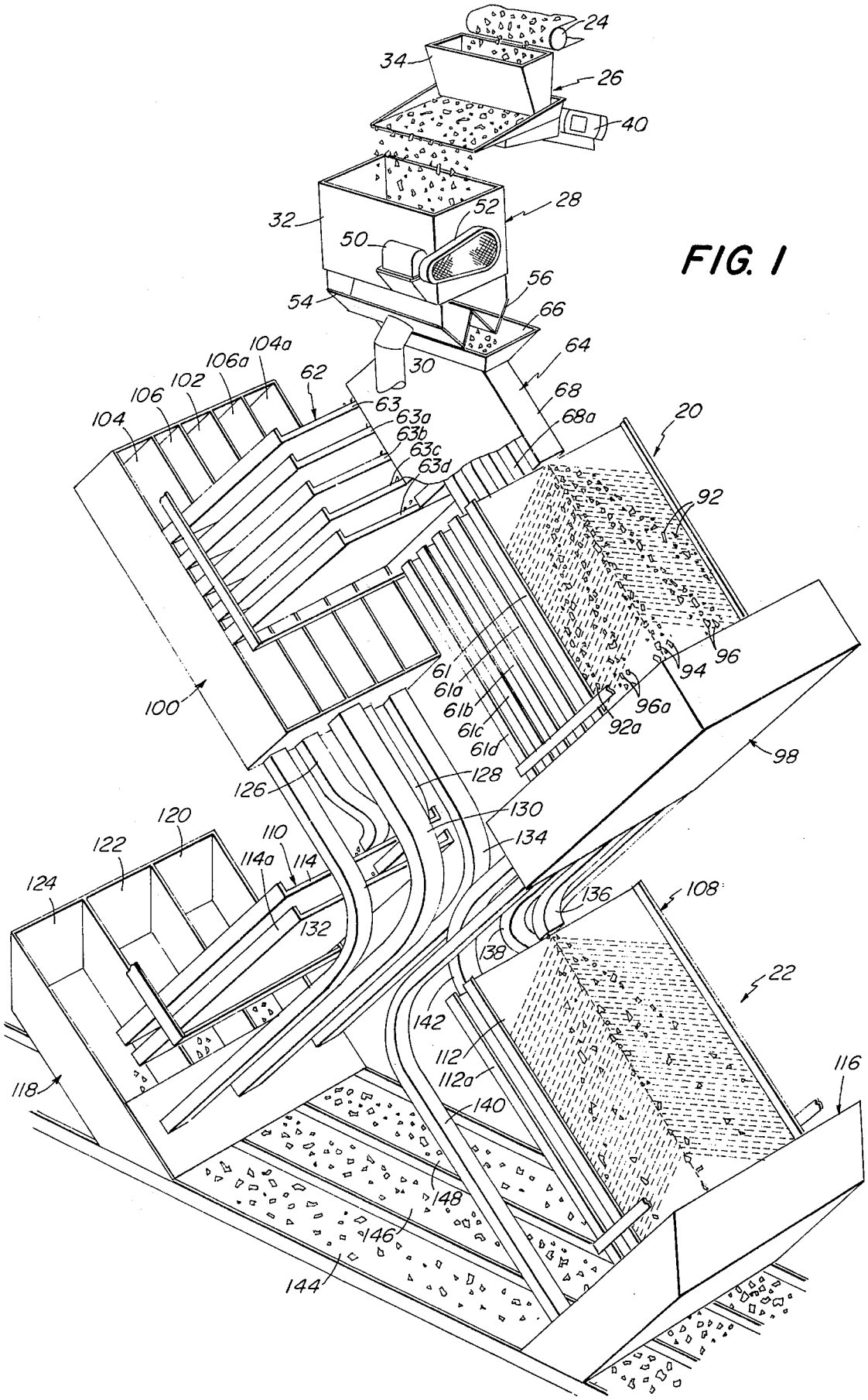
FIG. 1 is an isometric view of materials separating apparatus embodying the invention and showing the operative elements of the invention in somewhat schematic form.
Figure 2:
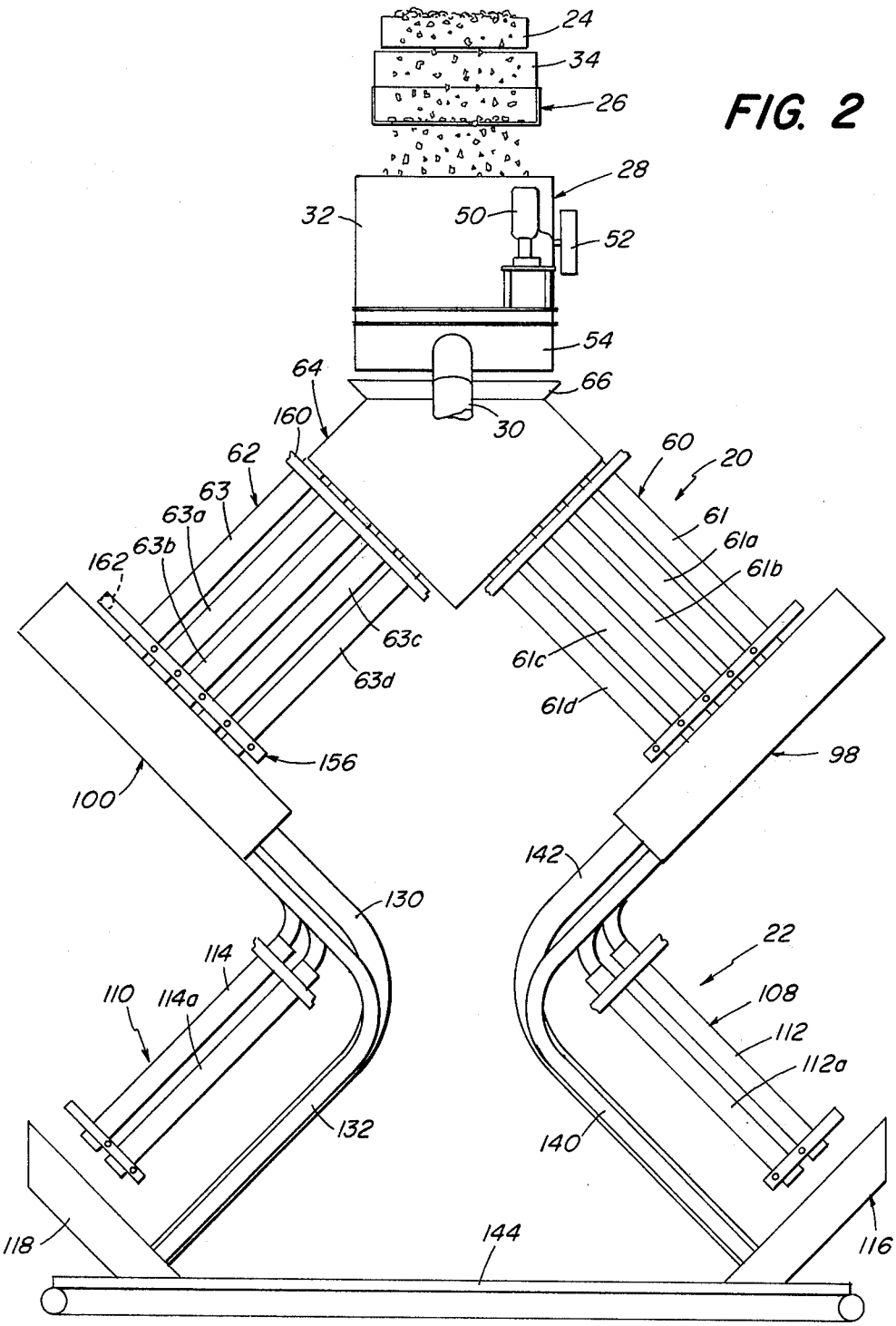
FIG. 2 is a front elevational view of the apparatus shown in FIG. 1.

Referring more particularly to the drawings wherein like characters of reference designate like parts throughout the several views, the materials separating apparatus embodying the invention, and as shown clearly in FIGS. 1 and 2, includes at least two stages of materials sorting or separation. Stage one, indicated generally by numeral 20, is located above the second stage 22. Material to the separated is first shredded by any suitable means not shown to a maximum size of about two inches, for example, and preferably with flat surfaces suitable for efficient sliding as opposed to rolling action. This material is directed toward the upper portion of first stage 20 as by a belt conveyor 24, screw, or the like from which it drops onto a vibratory feeder 26. The feeder 26 feeds the material into a magnetic drum separator 28 which separates ferromagnetic material from the remainder of the material and directs it outwardly by means such as a chute 30 to a suitable collector (not shown).

The vibratory feeder 26 may be any suitable mechanism which receives commingled material from the conveyor 24 and distributes it throughout the width of the hopper 32 forming part of the magnetic drum separator. One suitable vibratory feeder is Electromagnetic Vibratory Feeder sold by FMC Corp. of Homer City, Pa.

As shown in FIG. 6, the vibratory feeder 26 includes a trough 34 which may be mounted on springs 36 carried at the ends of suspension cables 38 and is vibrated by a number of magnets 40.

The magnetic drum separator 28 may be any suitable type such as the Model H or Model HFP sold by Eriez Magnetics of Erie, Pa. Such a magnetic drum separator 28 receives the material in its hopper 32 which, as shown in FIG. 7, is shaped to spread a thin layer of the material over a thin cylindrical nonmetallic shell 42 which rotates about axis 44 within an enclosure 45. An adjustable deflector 46 is provided to regulate the volume of flow of material onto the shell 42. A stationary permanent magnet assembly 48 is supported within the shell 42 and has a hemispherical cross-sectional shape, with its curved surface disposed adjacent one side of the inner surface of the shell 42. The outlet of the hopper 32 is disposed so that material therefrom will fall through an upper opening in the enclosure 45 onto a portion of the shell which overlies the magnet 48. As the shell is rotated by motor 50 and drive mechanism 52, ferromagnetic material will cling to the shell until it passes beyond the magnetic field of the magnet and will then fall into a first exit portion 54 and thence into chute 30. However, nonferromagnetic materials on the surface of the shell will fall off and pass through an opening in the enclosure 45 into a second exit portion 56. A suitable divider 58 beneath the separating assembly aids in maintaining segregation of ferromagnetic and nonferromagnetic materials.

The first sorting stage 20 comprises a first stack 60 and a second stack 62 of steady-state magnetic separating devices in the form of ramps. First stack 60 comprises five ramps 61, **61*a*, 61*b*, 61*c* and 61*d* which are superimposed in spaced relation one above another and inclined at substantially equal angles of inclination with their higher ends disposed toward the vibratory feeder 28. Second stack 62 comprises five similar spaced and inclined ramps 63, 63*a*, 63*b*, 63*c* and 63*d* having their upper ends also disposed toward the vibratory feeder 28 adjacent the upper end of stack 60. The ramps of the two stacks thus incline downwardly in divergent fashion as shown in FIGS. 1 and 2**, and may be employed in any selected numbers depending on the capacity of the apparatus and the character of the feed stock or commingled materials being separated.

A distributor 64 is located between the vibratory feeder 28 and upper ends of the ramps in the first sorting stage 20 and is structured to deliver a separate stream of materials from the feeder 28 to each individual ramp **61–61*d* and 63–63*d*. As shown best in FIG. 5, the distributor 64 has a trough or hopper 66 at its upper end into which drop materials from the vibratory feeder 28. From the bottom of the trough 66 extend a plurality of ducts, one for each ramp, which ducts are arranged in a fanlike fashion with half of the ducts directed toward stack 60 and the other half directed toward stack 62. Each of the ducts terminates at the upper end of a respective ramp so that materials falling from the hopper 66 and passing through the ducts will fall onto the exposed upper surface of a respective associated ramp. For example, a first duct 68 will function to deposit a stream of materials onto the upper end surface of ramp 61, and ducts 68*a*–68*d* will deposit individual streams of material or ramps 61*a*–61*d* of the first stack 60. Likewise, ducts 69–69*d* will simultaneously deposit materials on the upper end surfaces of ramps 63–63*d* of the second stack 62**. The upper end surface of each ramp upon which materials from the ducts fall are considered as "receiving means" as set forth in the claims herein.

Figure 4:
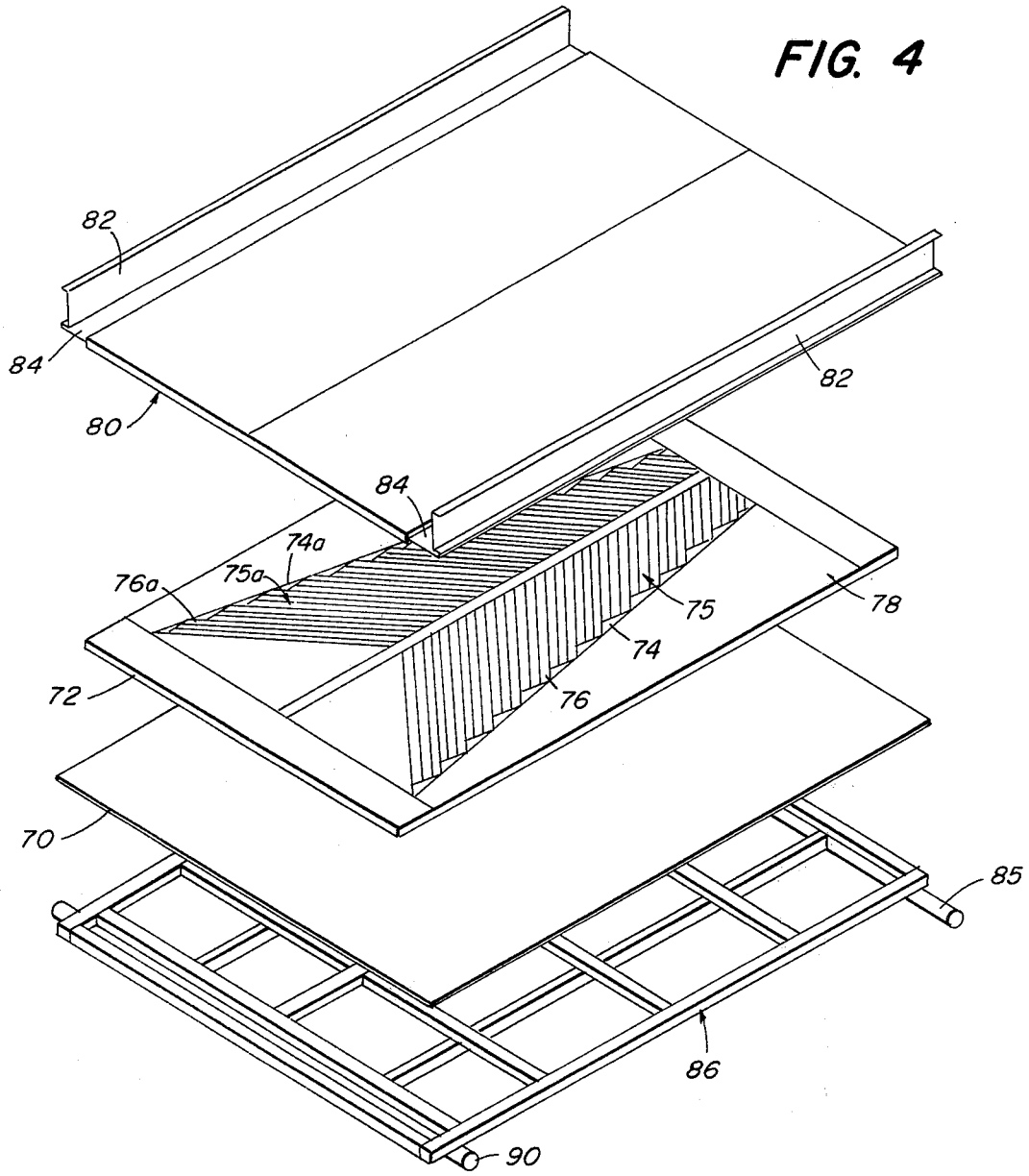
FIG. 4 is an exploded view showing the construction of one of the magnetic separating ramps.

Each ramp is preferably of the type clearly shown and described in the aforementioned copending Schloemann application and comprises basically, as shown in detail in FIG. 4, an inclined support plate 70 of nonmagnetic material such as cold rolled steel, for example. Upon support 70 is disposed a panel 72, preferably of wood, in the surface 78 of which are provided a pair of spaced shallow recesses 74 and 749 which extend longitudinally in tapered fashion as shown. Within each recess is provided a respective longitudinally extending arrangement of juxtaposed magnetic arrays 75 and **75*a***.

Each array comprises a parallel series of alternating oppositely polarized magnets 76 and **76*a*, respectively, which extends transversely of the inclined surface 78 of the panel 72** at a substantially uniform angle with the longitudinal center line thereof.

Corresponding magnets 76 and **76*a* of the arrays 75 and 75*a*, respectively, are disposed in reverse angulated relationship with respect to the longitudinal centerline of the surface of panel 72. Consequently, above the surface 78, each of the respective arrays 75 and 75*a* establishes a spatially alternating series of oppositely directed, static magnetic fields which, in combination, form a herringbone pattern along the slope of the inclined surface 78**. As a result, one longitudinal half of the ramp structure constitutes a mirror image of the other longitudinal half.

Overlaying the panel 72 and magnet arrays 75 and 75a is a top sheet 80 of nonmagnetic such as stainless steel, for example, which is provided at each side with a side rail 82 joined to the bottom thereof by a longitudinally extending marginal recessed area 84.

Each assembly of plate 70, panel 72 and sheet 80 is suitably mounted upon a frame 86 to the upper end of which is affixed a transversely extending pivot bar 88, and to the lower end of which is affixed a transversely extending support bar 90. The functions of bars 88 and 90 will be described subsequently herein.

Reference should be made to the aforementioned Schloemann application for further details of the structure and functions of the magnetic separating ramps. However, for the present invention it is believed merely necessary to point out that when commingled nonferromagnetic materials are deposited in a stream on the upper end surface of a ramp, gravitational forces acting upon the materials will cause them to move downwardly over the low friction surface of sheet 80. The materials thus will pass through the sequentially alternating series of oppositely directed, static magnetic fields created by the magnets 76 and 76*a* beneath the sheet 80.

As shown in FIG. 1, a relatively highly conductive item 92, such as aluminum, will have induced within it an eddy-current which exerts a force on the item directed substantially perpendicular to the underlying magnets, thus moving the item 92 laterally of the sheet 80 so that it will eventually fall off the bottom end of the ramp at or adjacent the outer side thereof. Such relatively highly conductive materials thus form an individual streamlet.

Nonconductive items 94 of nonferromagnetic material will not have eddy-currents induced within them and, consequently, are not deflected laterally. These nonconductive items 94 will thus drop straight down as a separate streamlet. A third streamlet will be formed by conductive items 96 which are less conductive than items 92, and this third streamlet will be disposed between the streamlets formed by highly conductive items 92 and nonconductive items 94.

It is to be understood that since opposite sides of the ramps are mirror-images of each other, there will be formed a single streamlet 94 of nonconductive items, two outer streamlets 92 and 92*a* of highly conductive material, and two intermediate streamlets 96 and 96*a* of less conductive materials. It will also be understood that each ramp in each stack of the first sorting stage 20 will produce five such streamlets. Thus, each stack of five ramps will produce five streamlets of nonconductive materials, 10 streamlets of highly conductive materials, and 10 streamlets of less conductive materials. From the entire first sorting stage there are produced ten streamlets of nonconductive materials, 20 streamlets of highly conductive materials, and 20 streamlets of less conductive materials.

Figure 9:
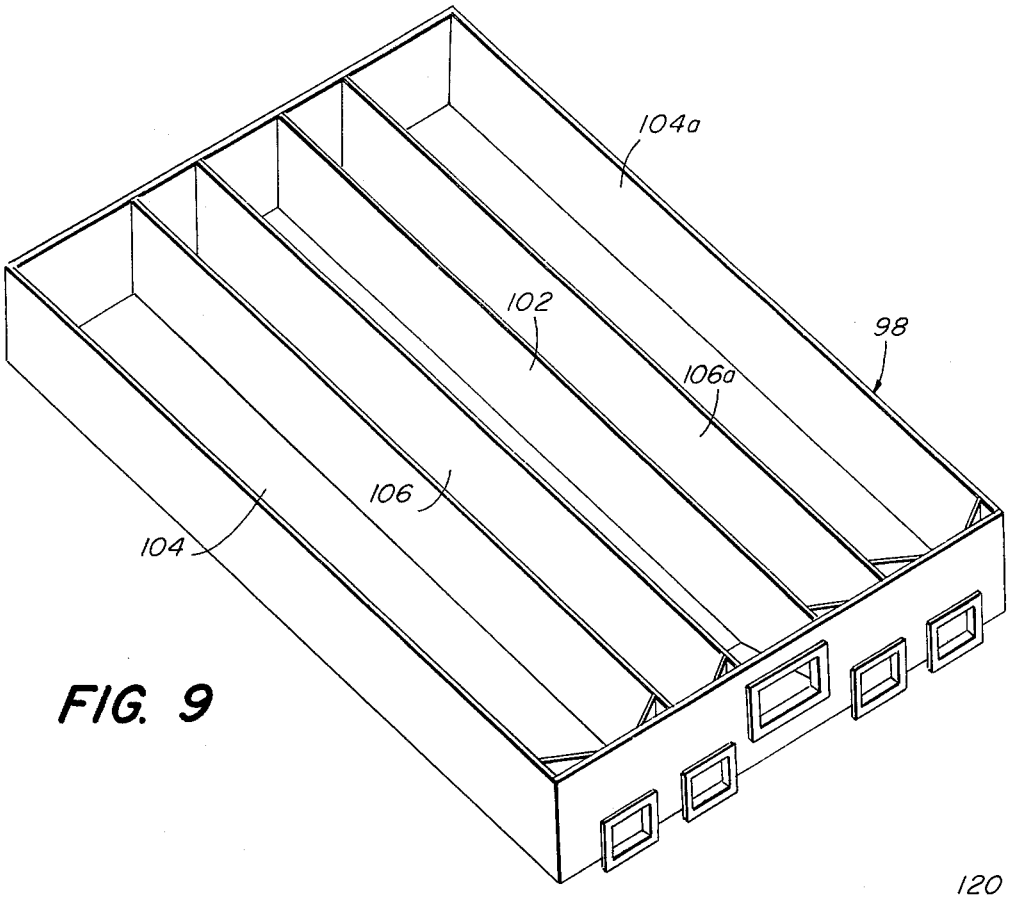
FIG. 9 is as isometric view of the first stage collector.

The streamlets from first stack 60 fall into a collector 98 while streamlets from second stack 62 fall into a second collector 100. The collectors 98 and 100 are similar in construction and details thereof are shown in FIG. 9. The collector comprises a boxlike structure containing five parallel longitudinally extending compartments defined by partitions or walls which are adjustable to selectively control the sizes of the compartments and, consequently, the purity characteristics of the output products from the respective ramps. Into the central compartment 102 fall the nonconductive materials in streamlet 94. The highly conductive items of streamlets 92 and 92*a* fall into the outer compartments 104 and 104*a* respectively, and the less conductive materials of streamlets 96 and 96*a* fall into intermediate compartments 106 and 106*a* respectively.

The collectors 98 and 100 are inclined perpendicular to the respective stacks 60 and 62 at the lower ends thereof so as to efficiently collect all the segregated streamlets. For example, all the five streamlets 94 of nonconductive materials from the five ramps 61–61*d* will be collected in compartment 102, all five streamlets 92 of highly conductive material will be collected in compartment 104, all five streamlets 96 of less conductive materials will be collected in compartment 106, all five streamlets 92*a* of highly conductive material will be collected in compartment 104*a*, and all five streamlets 96*a* of less conductive materials will be collected in compartment 106*a*. Thus, each collector 98 and 100 will collect all the streamlets emerging from the first sorting stage 20.

Beneath the first sorting stage 20 is the second sorting stage 22 which comprises two lower stacks 108 and 110 of magnetic separating ramps similar to the ramps in uppr stacks 60 and 62. Lower stack 108 contains two spaced overlying ramps 112 and 112*a* which are inclined similarly to and parallel with upper ramps 61–61*d* of stack 60, while lower stack 110 likewise contains two spaced overlying ramps 114 and 114*a* which are inclined similarly to and parallel with upper ramps 63—63*d* of stack 62.

Figure 10:
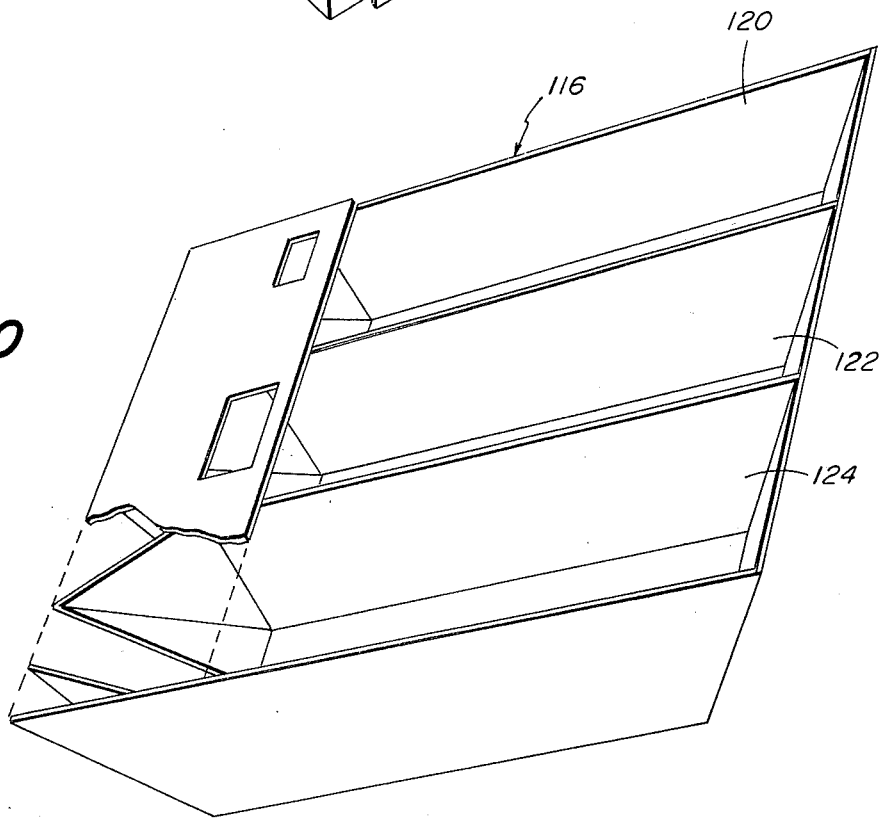
FIG. 10 is an isometric view of the second stage collector.

Beneath each lower stack 108 and 110 is a respective lower collector 116 and 118, each of which collectors is disposed at an inclination as shown so as to lie perpendicular to the respective ramps in the lower stacks. As shown best in FIGS. 8 and 10, each lower collector is a boxlike structure containing three parallel longitudinally extending compartments or bins 120, 122 and 124 for receiving segregated materials, as will be described.

Figure 8:
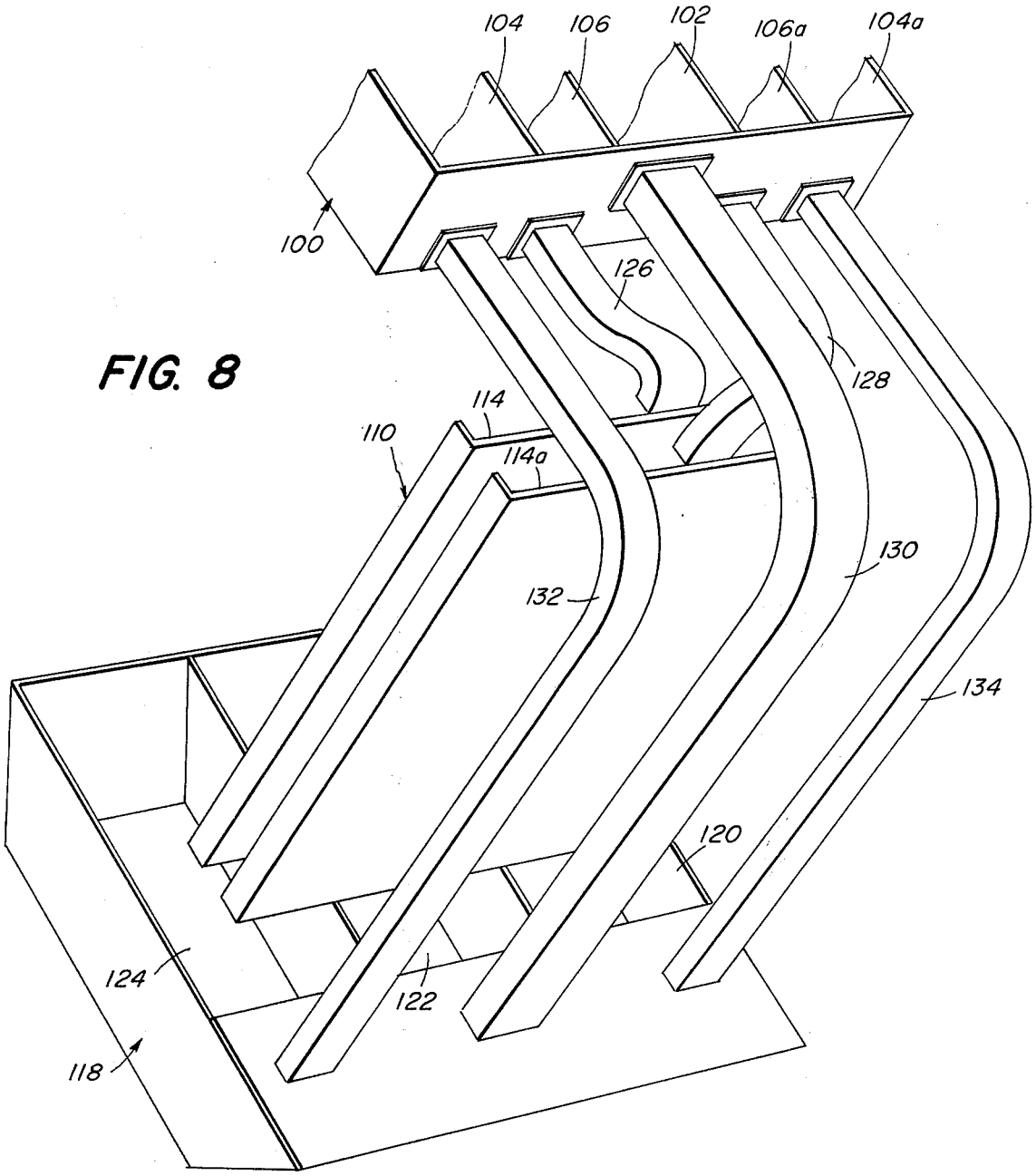
FIG. 8 is an isometric view of the second sorting stage.

From FIG. 8 it will be understood that selected materials from the upper or first sorting stage will be transferred from the respective collector 98 and 100 to the second or lower sorting stage directly beneath it. For example, middlings or less conductive materials will sometimes contain some small amounts of highly conductive materials which were not separated therefrom in the first sorting stage, possibly because of buildup of materials on the upper ramps or other interference which prevented the highly conductive materials from being fully deflected laterally in the desired manner.

Therefore, compartments 106 and 106*a* of collector 100, for exampled, are operatively connected with the ends of respective ramps 114 and 114*a* by individual chutes 126 and 128 respectively. Thus middlings from compartment 106 will downwardly through chute 126 onto the surface of ramp 114. Since the ramps 112, 112*a*, 114 and 114*a* are all constructed similarly to the uppper ramps 61–61*d*, and 63–63*d*, it will be apparent that the middling materials passing from compartment 106 through chute 126 to ramp 114 will be pulled downwardly by gravity over the magnets therein, and in doing this the materials will be split into three streamlets. The highly conductive materials will be deflected out towards each side of the ramp and will eventually fall into the outer bins 120 and 124 of collector 118. The less conductive materials will fall into the central bin.

Likewise, the middlings in compartment 106*a* of the upper collector 100 will pass downwardly through chute 128 to the second ramp 114*a* of stack 110 which will separate it into three segregated portions, outer highly conductive portions which will also fall into bins 120 and 124, and a central bin 122.

From FIg. 8 it will also be seen that the tailings in compartment 102 of collector 100 of the upper stack will pass downwardly through a longer chute 130 directly into the central bin 122 of collector 118 where it will mix with the materials therein to be discarded or reprocessed. The highly conductive materials in compartments 104 and 104*a* which are to be salvaged are allowed to pass downwardly through respective chutes 132 and 134 directly into bins 124 and 120 respectively in lower collector 118 for mixing with the highly conductive materials already therein from the ramps of lower stack 110.

It will be understood that the other lower stack 108 will perform similarly to reprocess the materials in the two middling compartments of upper collector 98. These materials will pass through chutes 136 and 138 to the two magnetic separating ramps 112 and 112*a* respectively. From these two ramps, the materials sliding thereover will be separated into two laterally deflected portions of high conductivity metals and a central portion of lower conductivity. The high conductivity metals will fall into the outer bins of collector 116 while the central portion of lower conductivity material will fall into the central bin therein. Also highly conductive metal from the outer compartments 104 and 104*a* of upper collector 98 will fall downwardly through respective chutes 140 directly to the outer bins in lower collector 116, while trailings or nonconductive materials from the central compartment 102 in upper collector 98 will drop through chute 142 directly to the central bin in lower collector 116.

Beneath the lower collector 116 and 118 are suitable means for removing the segregated materials. For example, three conveyors 114, 146 and 148 may be used for this purpose. The conveyors are located beneath both lower collectors, and the bottom of the collectors have openings for allowing the materials in the bins to drop onto the respective conveyors. Conveyor 114 and conveyor 148 are disposed beneath the outer bins of the collectors and, therefore, highly conductive metals to be salvaged are collected thereon and transferred to a a suitable location for continued processing. The nonconductive and lower conductivity materials which are in the middle bins of the collectors and which are not necessarily to be salvaged are collected on middle conveyor 146 for transferral to a suitable disposition area.

Figure 3:
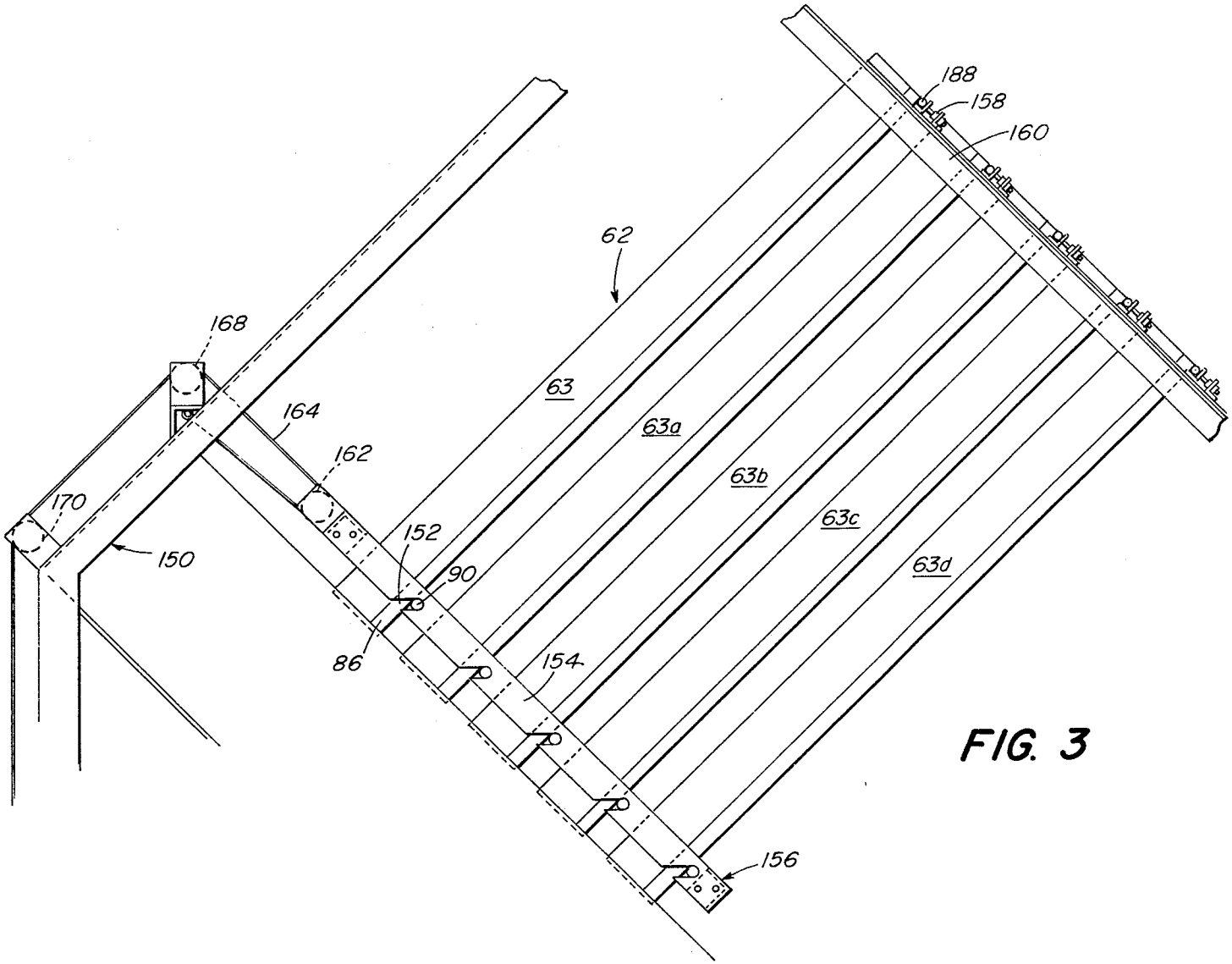
FIG. 3 is a side elevational view of one of the stacks of magnetic separating ramps of the first sorting stage.
Figure 11:
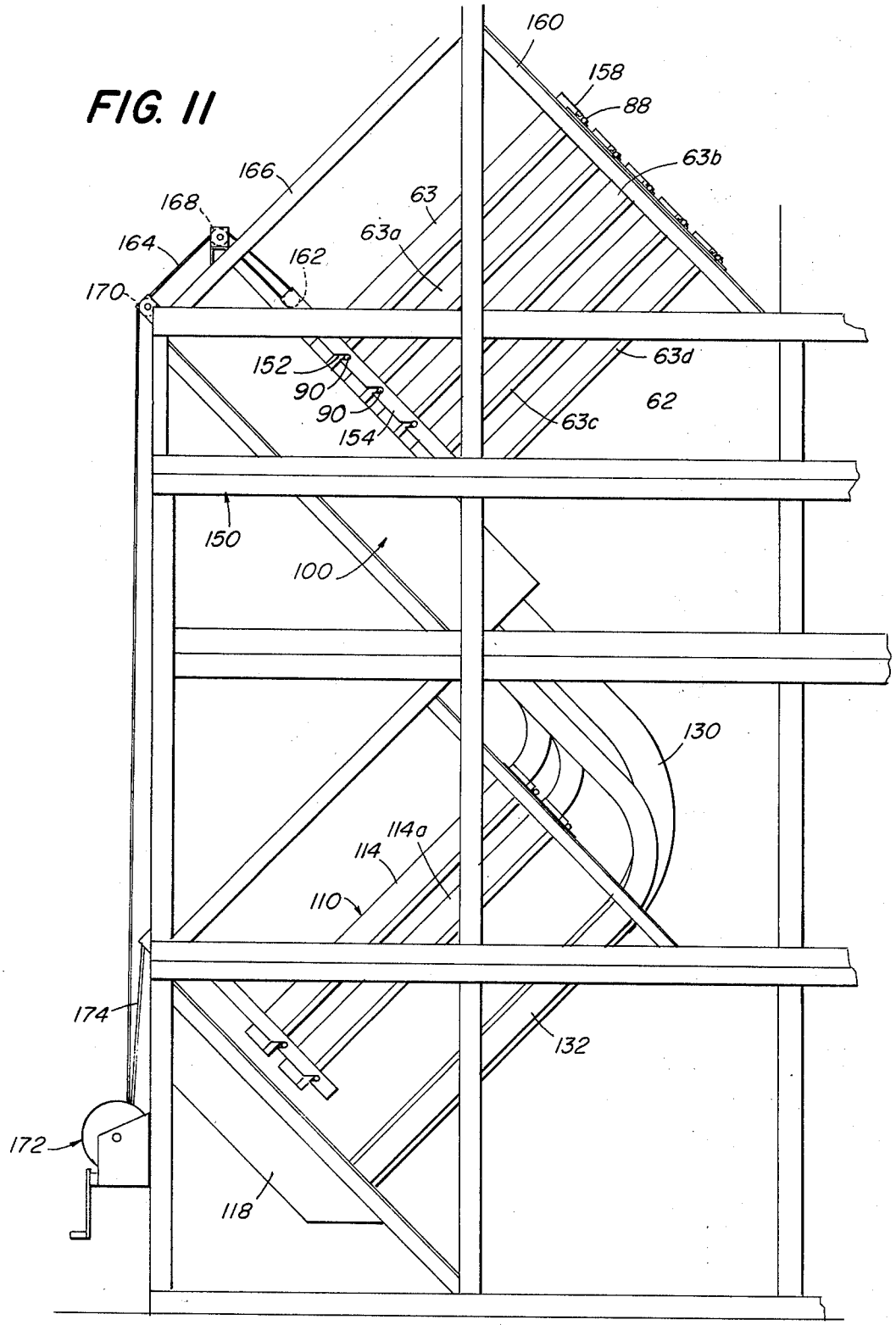
FIG. 11 is a front elevational view of a portion of the apparatus showing the ramp adjustment mechanism.

It will be further understood that the composition of the raw commingled materials which reach the magnetic segregating ramps may vary considerably from day to day, or even from hour to hour, and this could affect the slidability of the materials along the surfaces of the ramps. Therefore, means may be provided for varying the angle of inclination of the ramps as may be required. Referring to FIGS. 3 and 11, this is achieved by means which may be manually operated as shown, or may be motor operated.

The apparatus, including the stacks of ramps, is necessarily supported upon a suitable framework of wood or metal. This framework is not shown in the drawings in order to more clearly depict the invention, except that a portion 150 only of the framework is shown in FIGS. 3 and 11 in order to fully illustrate the mechanism for adjusting the angle of inclination of the ramps.

The angle adjusting mechanism is shown applied to the upper and lower stacks 62 and 110 of ramps on one side of the apparatus. However, it is to be understood that the other stacks 60 and 108 are similarly adjustable. The lower ends of the ramps 63–63*d* of stack 62 are individually suspended by the support bars 90 on each ramp support frame 86, while support bars 90 rest within spaced slots 152 in the side bars 154 of a plate-lifting frame 156 which encircles the lower end of the stack 62. At the upper end of the stack 62 the ramps are supported by their respective pivot bars 88 which are secured by individual ramp leveling devices 158 to a portion 160 of the framework 150.

The outer end of the plate-lifting frame 156 carries a pulley 162 over which is wound a cable 164. One end of the cable 164 is secured to a girder 166 which carries a pair of spaced pulleys 168 and 170. From the first pulley 162 the cable 164 extends over pulleys 168 and 170 and passes downwardly to a ratchet type hand crank device 172. By operation of the crank device 172 the lower end of the upper stack 62 may be raised and lowered to vary the angle of inclination of the ramps 63–63*d*.

The lower stack 110 and ramps 114 and 114*a* thereon are similarly constructed and are adjusted by a second cable 174 also attached to crank device 172. Thus, both upper and lower stacks of ramps may be adjusted simultaneously.

It will be apparent from the foregoing that an improved and efficient apparatus has been provided in accordance with this invention for segregating relatively highly conductive nonferromagnetic metals such as aluminum from a supply of commingled nonferromagnetic materials. It will also be apparent that various modifications and changes in the apparatus shown and described and in its method of operation may be made by those skilled in the art without departing from the spirit of the invention as expressed in the accompanying claims. Therefore, all matter shown and described is to be interpreted as illustrative and not in a limiting sense.

What is claimed is:

1. Apparatus for separating conductive nonferromagnetic metals from a supply of a commingled nonferromagnetic materials comprising a first sorting stage including means for separating said supply into a first portion comprising nonconductive materials, a second portion comprising conductive metals, such as aluminum, having relatively high conductivity, and a third portion comprising a streamlet of primarily conductive materials having lower conductivity than said second portion, said first stage comprising a plurality of inclined first ramps each of which has means at its upper end for receiving a respective stream of commingled nonferromagnetic materials, said first ramps each having steady-state magnetic means for separating its respective stream into said first, second, and third portions, and a second stage including at least one inclined second ramp positioned to receive said streamlets from said first ramps, said second ramp including permanent magnet means disposed to establish an alternating series of oppositely directed magnetic fields at an oblique angle to said streamlets for segregating therefrom conductive metals having relatively high conductivity which may be included therein.

2. Apparatus as set forth in claim 1 wherein means is provided for selectively varying the angle of inclination of said first and second ramps.

3. Apparatus as set forth in claim 1 wherein are further provided distributing means operatively positioned with respect to said receiving means of the first ramps to distribute said materials to all said first ramps, said ramps in said first stage being stacked in parallel spaced overlying relation, and said distributing means comprising conveying mechanism having means for conveying said materials to a location adjacent one end of said stack of ramps.

4. Apparatus as set forth in claim 3 wherein said conveying mechanism further includes a plurality of openended ducts having one end located adjacent the receiving means of the respective ramps, and a vibratory means for receiving said materials from said conveying mechanism and distributing the materials into the opposite ends of said ducts.

5. Apparatus for separating conductive nonferromagnetic metals from a supply of commingled nonferromagnetic materials comprising first and second sorting stages, said first sorting stage comprising a plurality of inclined ramps each of which has means at its upper end for receiving a respective stream of commingled nonferromagnetic materials and steady-state magnetic means disposed to establish an alternating series of oppositely directed and substantially parallel magnetic fields transversely at an oblique angle to the stream for separating its respective stream into a first streamlet comprising nonconductive materials, a pair of second streamlets comprising conductive metals, such as aluminum, having relatively high conductivity, and a pair of third streamlets comprising primarily conductive materials having lower conductivity than the metals of said second streamlets, distributing means operatively positioned with respect to said receiving means of the ramps of said first stage to distribute said supply of materials to all of said ramps of the first stage, and said second stage comprising at least one second ramp positioned to receive said third streamlets from said first ramps and including permanent magnet means disposed to establish an alternating series of opositely directed magnetic fields at an oblique angle to said third streamlets for segregating from said third streamlets conductive metals having relatively high conductivity which may be included therein.

6. Apparatus as set forth in claim 5 wherein said ramps in said first stage are stacked in parallel spaced in parallel spaced overlying relation, and said distributing means comprises conveying mechanism having means for conveying said materials to a location adjacent one end of said stack of ramps.

7. Apparatus as set forth in claim 6 wherein said conveying mechanism further includes a plurality of openended ducts having one end located adjacent the receiving means of the respective ramps, and a vibratory means for receiving said materials from said conveying mechanism and distributing the materials into the opposite ends of said ducts.

8. Apparatus for separating conductive nonferromagnetic metals from a supply of commingled nonferromagnetic materials comprising first and second sorting stages, said first sorting stage comprising two stacks of spaced inclined ramp each of which ramps has means at its upper end for receiving a respective stream of commingled nonferromagnetic materials and steady-state magnetic means for separating its respective stream into a first streamlet comprising nonconductive materials, a pair of second streamlets comprising conductive metals, such as aluminum, having relatively high conductivity, and a pair of third streamlets comprising primarily conductive materials having lower conductivity than the metals of said second streamlets, and said second stage comprising at least one second ramp positioned to receive said third streamlets from said first ramps and including permanent magnet means disposed to establish an alternating series of oppositely directed magnetic fields at an oblique angle to said third streamlets for segregating from said third streamlets conductive metals having relatively high conductivity which may be included therein.

9. Apparatus as set forth in claim 8 wherein distributing means is disposed adjacent the upper ends of said stacks for distributing said supply of materials to all of the ramps in both of said stacks.

10. Apparatus as set forth in claim 9 wherein the upper ends of said stacks are disposed adjacent to each other and to said distributing means, and said ramps in the respective stacks extend downwardly in divergent directions.

11. Apparatus as set forth in claim 10 wherein said distributing means comprises conveying means, and a fanshaped array of ducts which ducts each have one disposed adjacent a respective ramp.

12. Apparatus as set forth in claim 11 wherein vibratory means is disposed between said conveying means and ducts for distributing said materials from the conveying mechanism to all of said ducts.

13. Apparatus as set forth in claim 12 wherein said second stage comprises two pairs of second ramps, one pair being disposed to receive flow of third streamlets from one of said stacks of the first stage, and the other pair of second ramps being disposed to receive flow of third streamlets from the other stack of the first stage, said second ramps each having steady-state magnetic means for separating from its respective third streamlets conductive metals having relatively high conductivity which may be included therein.

14. Apparatus as set forth in claim 13 wherein means is provided for selectively varying the angle of inclination of the ramps in said first and second stages.

* * * * *

UNITED STATES PATENT OFFICE

CERTIFICATE OF CORRECTION

Patent No. 4,029,573 Dated August 3, 1977

Inventor(s) Michael J. Theodore and John S. DiMercurio

It is certified that error appears in the above-identified patent and that said Letters Patent are hereby corrected as shown below:

Col. 4, line 33, "or" should be -- on --;
line 68, after "magnetic" insert -- material --.

Col. 6, line 22, "uppr" should be -- upper --.

Col. 7, line 3, after "central" insert -- less conductive portion which will fall into central --;
line 4, "FIg" should be -- Fig --;
line 31, "trailings" should be -- tailings --;
line 35, "collector" should be -- collectors --;
line 42, "114" should be -- 144 --.

Col. 10, line 36 (in claim 11), after "one" insert -- end --.

Signed and Sealed this

Fourth Day of October 1977

[SEAL]

*Attest:*

RUTH C. MASON
*Attesting Officer*

LUTRELLE F. PARKER
*Acting Commissioner of Patents and Trademarks*